US011649571B2

(12) United States Patent
Siewert

(10) Patent No.: US 11,649,571 B2
(45) Date of Patent: May 16, 2023

(54) METHOD FOR MONITORING AIR FLOWS REQUIRED FOR HANDLING A THREAD AND/OR FIBER BAND AND SPINNING MACHINE UNIT

(71) Applicant: Saurer Spinning Solutions GmbH & Co. KG, Übach-Palenberg (DE)

(72) Inventor: Ralf Siewert, Schwalmtal (DE)

(73) Assignee: Saurer Spinning Solutions GmbH & Co. KG, Übach-Palenberg (DE)

( * ) Notice: Subject to any disclaimer, the term of this patent is extended or adjusted under 35 U.S.C. 154(b) by 0 days.

(21) Appl. No.: 16/879,463

(22) Filed: May 20, 2020

(65) Prior Publication Data

US 2020/0370208 A1 Nov. 26, 2020

(30) Foreign Application Priority Data

May 24, 2019 (DE) ..... 102019113977.5

(51) Int. Cl.
*D01H 13/32* (2006.01)
*D01H 13/16* (2006.01)

(52) U.S. Cl.
CPC ..... *D01H 13/32* (2013.01); *D01H 13/1683* (2013.01)

(58) Field of Classification Search
CPC .... D01H 13/14; D01H 13/1683; D01H 13/32; D01H 1/115; D01H 4/48; B65H 63/04
See application file for complete search history.

(56) References Cited

U.S. PATENT DOCUMENTS 5,182,900 A * 2/1993 Horak ..... D01H 15/00 57/22
2006/0096271 A1* 5/2006 Yamamoto ..... D01H 1/115 57/350

(Continued)

FOREIGN PATENT DOCUMENTS

DE 19511960 A1 10/1996
DE 10137081 A1 2/2003

(Continued)

OTHER PUBLICATIONS

European Search Report, European Application No. EP20175578, dated Sep. 21, 2020, 2 pages.

(Continued)

*Primary Examiner* — Shaun R Hurley
*Assistant Examiner* — Patrick J. Lynch
(74) *Attorney, Agent, or Firm* — Nelson Mullins Riley & Scarborough LLP

(57) ABSTRACT

A method for monitoring air flows required for handling a thread and/or fiber band in a spinning machine, and to a spinning machine unit. At least one air flow-generating source is connected to an air flow duct. An air volume flow measuring unit is connected to an evaluation device for data transmission. The air volume flow is measured by the air volume flow measuring unit and the measurement result is transmitted to the evaluation device. The number of productive and/or non-productive spinning positions is detected. An air volume flow target value is determined by the evaluation device. The air volume flow target value is compared with actual value of the measured air volume flow by the evaluation device, the evaluation device making an evaluation on the basis of the comparison as to whether there is an unacceptable deviation between the actual value and the air volume flow target value.

11 Claims, 2 Drawing Sheets

(56) References Cited

U.S. PATENT DOCUMENTS

| | | | | |
|---|---|---|---|---|
| 2008/0041029 | A1* | 2/2008 | Schaeffler | D01H 4/02 57/264 |
| 2008/0190090 | A1* | 8/2008 | Schaeffler | D01H 1/115 57/415 |

FOREIGN PATENT DOCUMENTS

| | | | | |
|---|---|---|---|---|
| DE | 102006050220 | A1 | 4/2008 | |
| DE | 102016009027 | A1 * | 1/2018 | B65H 63/0328 |
| EP | 2450478 | A2 * | 5/2012 | D01H 1/115 |
| EP | 3705611 | A1 * | 9/2020 | D01H 13/14 |
| JP | 2002138346 | A * | 5/2002 | |

OTHER PUBLICATIONS

Office Action from Bangladeshi Patent Application No. 132/2020, dated Feb. 8, 2021, 1 page.
Office Action from Indian Patent Application No. 202024022470, dated Nov. 30, 2021, all enclosed pages cited.

* cited by examiner

METHOD FOR MONITORING AIR FLOWS REQUIRED FOR HANDLING A THREAD AND/OR FIBER BAND AND SPINNING MACHINE UNIT

CROSS-REFERENCE TO RELATED APPLICATION

This application claims priority from German National Patent Application No. DE 10 2019 113 977.5, filed May 24, 2019, entitled "Verfahren zur Überwachung von erforderlichen Luftströmen zum Handhaben eines Fadens und/oder Faserbandes and Spinnmaschineneinheit", the entire contents of which are incorporated herein by reference.

FIELD OF THE INVENTION

The present invention relates to a method for monitoring air flows required for handling a thread and/or fiber band in a spinning machine having a plurality of spinning positions, and to a spinning machine unit for carrying out the method.

BACKGROUND OF THE INVENTION

As is known, spinning machines have a plurality of spinning positions of the same type, which are equipped with handling units for handling a thread and/or a fiber band and require an air flow at least from time to time in order to handle either the fiber band in the course of the spinning process or the spun thread, in particular to influence the quality. The air flow is usually generated by at least one air flow-generating source. Depending on the type of spinning machine, it can be a suction air system, which is used in particular in a rotor spinning machine, for example to generate a spinning vacuum, or a compressed-air-generating source, which is used in particular in an air spinning machine to generate a spinning pressure.

Accordingly, the spinning rotor of the rotor spinning machine can be regarded as a handling unit, the rotor cup of which is supplied with suction air not only during regular spinning operation, but also during a piecing process. In the case of an air spinning machine, the spinning nozzle can rightly be regarded as a handling unit. In general, all devices which pneumatically handle a thread or a fiber band can be considered to be handling units.

For the quality of the thread produced by the spinning machine, it is necessary that the air flow, in particular the associated pressure, vacuum or volume flow is within a defined range for proper handling of the thread or fiber band by the handling unit. Furthermore, it maximizes the productivity of the machine if the air flow is provided as soon as possible after a corresponding request, otherwise the handling unit would have an unproductive waiting time. On the other hand, configuring the air flow-generating source for a maximum air flow requirement increases its costs in a disadvantageous way. Similarly, providing an air flow above a level that is currently required increases energy consumption. It may be necessary to provide such an air flow if, among other things, losses occur within the air flow path, for example due to leakages.

Therefore, it has become established in the state of the art for certain waiting times for the air flow to be accepted, at least in extreme situations, and for the air flow to be adjusted as exactly as possible to the required demand. However, since air flow regulation is relatively sluggish, mainly due to the length of the air flow ducts, the required air flow often cannot be maintained with purely tracking controls.

For this reason, it has been proposed, for example in the German Patent Publication DE 195 11 960 A1, that a handling unit must give notification of its air flow requirement in advance, i.e. that it should submit a request, in response to which the air flow control adjusts the air flow sufficiently in good time before the call for the air flow is made, so that even after this request has been allocated, sufficient air flow is maintained for all connected handling elements. This can lead to increased energy consumption due to the increase in the required energy uptake. When a maximum permitted energy uptake is reached, further requests are no longer allocated, but instead the requesting handling unit is put into a waiting position. Waiting handling units are not served again until the energy uptake has dropped sufficiently by processing prior requests.

The German Patent Publication DE 10 2006 050 220 A1 proposes a priority-controlled processing of the requests. In particular, the waiting times for scarce resources, such as operating units responsible for a plurality of workstations and operating personnel, can be reduced.

The German Patent Publication DE 10 2006 050 220 A1 discloses distributing the handling units' requests at spinning position level. Specifically, only allocations to a certain number of spinning positions are permitted. If the maximum number has been reached, requests from other handling units are placed in the queue. Consequently, the air flow cannot be allocated to a waiting spinning position until one of the spinning positions currently being supplied has finished its work for which it had requested the air flow, i.e. when the spinning position no longer has any current need.

All previously disclosed solutions share the characteristic that air flow losses due to, for example, leakages along the air flow path are not explicitly taken into account. Such losses can have such a negative effect on the functionality of the corresponding handling unit that an insufficient air flow at the handling unit can lead to a loss of quality of the thread or fiber band to be handled by the handling unit. For example, an insufficient spinning pressure or spinning vacuum can lead to the production of a lower-quality thread. Another example is that insufficient pressure to compress the fibers of a fiber band in the region of a drafting system of the spinning machine can also lead to a lower-quality thread.

SUMMARY OF THE INVENTION

Against this background, the aim of the present invention is to make it possible to monitor the air flows required for handling a thread and/or fiber band and detect undesired air flow losses, e.g. due to leakages, in particular in a simple and cost-effective manner. In the context of the present invention, an air flow is understood to be an air flow generated by vacuum over positive pressure, in which case an air flow generated by vacuum differs from the air flow generated by pressure only on account of the direction of air flow.

For this purpose, according to a first aspect of the present invention, a method is proposed for monitoring air flows required for handling a thread and/or fiber band in a spinning machine having a plurality of spinning positions. The spinning machine is assigned at least one air flow-generating source, which is connected, in an air flow-communicating manner, hereinafter referred to as "on the flow side", to an air flow duct carrying the air flow, the air flow duct having an air flow main duct, coupled to the source on the flow side, and a plurality of air flow branch ducts branching off from the air flow main duct. The air flow branch ducts each branch off to one spinning position for supplying the air flow to the spinning position's own handling units for handling the thread or fiber band. The spinning machine is furthermore allocated an evaluation device for evaluating measurement data and a detection unit for detecting productive and/or non-productive spinning positions and/or handling units, the detection unit being connected to the evaluation device for data transmission. In general, a data transmission connection can be implemented in the usual manner, in particular wired or wireless, according to the requirements.

The source, the evaluation device and/or the detection unit can preferably be included in the spinning machine. Alternatively, the source, the evaluation device and/or the detection unit can be located outside the spinning machine and be operatively connected thereto, thus forming a spinning machine unit in the context of the present invention.

The invention is characterised in that an air volume flow measuring unit is provided which is arranged in the air flow main duct between the source and the air flow branch duct nearest to the source along the air flow path, the air volume flow measuring unit being connected to the evaluation device, in particular for data transmission in the manner described above. In the course of the method, the air volume flow is measured by means of the air volume flow measuring unit and the measurement result is transmitted to the evaluation device, for example in the form of a specific measured value or a code representing the measured value. Furthermore, the number of productive and/or non-productive spinning positions and/or handling units is detected by means of the detection unit at the time of the air volume flow measurement and transmitted to the evaluation device. A spinning position or handling unit is in productive mode until it no longer requires an air flow for producing the thread or for handling the thread and/or fiber band, for example due to a malfunction and the associated shutdown of the spinning position. Purely example processes defining a productive mode are, for example, piecing, spinning the thread, placing a thread end on an empty tube, compacting the fiber band or the like. All of these processes require air flows, which corresponding handling units use to handle the thread or fiber band.

In the course of the method, an air volume flow target value is also determined depending on the number of productive and/or non-productive spinning positions detected at the time when the air volume flow is measured, the air volume flow target value corresponding to a total air volume flow requirement of the spinning positions which are productive at the time when the measurement is taken. The determined air volume flow target value is compared with the actual value of the measured air volume flow and the comparison is evaluated to determine whether there is an unacceptable deviation between the actual value and the air volume flow target value. An unacceptable deviation can occur, for example, if the target value defines a limit of a value range that is considered tolerable or acceptable and the actual value of the measured air volume flow is outside the value range. A further unacceptable deviation can occur if a differential value between the actual value and the target value exceeds a fixed, corresponding threshold value.

The processes of determining, comparing and evaluating are carried out by the evaluation device. In the context of the present invention, an evaluation device is defined as those functionally interacting elements or units which are designed to carry out these necessary processes. The elements or units can be separate from one another or be implemented in a common assembly. The evaluation device can preferably be a processor-based device such as a control unit assigned to one or more spinning machines or spinning positions.

As soon as a deviation is evaluated as being unacceptable, an alarm signal can be initiated according to a preferred embodiment of the present invention. The alarm signal is initiated when the evaluation device transmits a signal suitable for triggering the alarm signal, for example directly to a unit triggering the alarm signal or to an intermediate unit. The alarm signal can be a visual, optical, acoustic and/or haptic signal. By means of such an alarm signal, an operator of the spinning machine can be informed of an improper operation of the spinning machine, in particular of an air flow which is not appropriate for handling the thread or fiber band and which can lead to a lower-quality thread.

The proposed method provides a cost-effective and very straightforward way of monitoring air flows and in particular identifying air flow losses in a spinning machine.

The processes of measuring, transmitting, determining, comparing and evaluating can be carried out continuously, periodically or at fixed times, depending on the energy consumption requirements. The more frequently such processes are carried out, the higher the potential corresponding energy requirement of the spinning machine but the more reliable the monitoring and the possibility of direct intervention or troubleshooting, which allows the productivity of the spinning machine to be optimized.

The method proposed by the present invention is particularly preferably suitable for a spinning machine designed as an air spinning machine, the air flow-generating source being a compressed-air source at least for generating a predetermined spinning pressure in a spinning unit or spinning nozzle of the spinning position.

In accordance with a preferred embodiment, the alarm signal also contains, in addition to the information on an insufficient air flow supply, the information about which spinning position portion is affected, more preferably which spinning position is affected, and even more preferably which handling unit and/or air flow branch duct is affected. For this purpose, a further air volume flow measuring unit is preferably arranged in at least one air flow branch duct, in particular in each air flow branch duct leading to a spinning position or directly to a handling unit, the further air volume flow measuring unit in particular being able to be assigned its own retrievable code for identifying the spinning position or the handling unit or the air flow branch duct. At a fixed time, the air volume flow is measured by the further air volume flow measuring unit and transmitted to the evaluation device. At the time the air volume flow is measured, the detection unit is used to determine whether the spinning position or handling unit which is operatively connected to the further air flow measuring unit is productive and/or non-productive. A corresponding individual actual value of the measured air volume flow is assigned to the productive spinning position or handling unit and compared with an individual target value which corresponds to a total air volume flow requirement of the operatively connected spinning position or handling unit. On the basis of the comparison, the evaluation device evaluates whether there is an unacceptable deviation between the individual actual value and the individual target value. If a deviation is evaluated as being unacceptable, an alarm signal is initiated, which includes information about the further air volume flow measuring unit, spinning position, handling unit and/or air flow branch duct affected by the unacceptable deviation.

Furthermore, the air flow branch duct preferably has a closing element for closing the air flow branch duct, particularly preferably near the branch from the air flow main duct. The closing element can preferably be moved manually and/or automatically between an open position for the passage of the air volume flow and a closed position for closing the air flow branch duct. Whenever there is an unacceptable deviation, such a closing element offers the advantage that only the spinning position or handling unit that is affected by the air flow loss needs to be shut down or separated from the air flow feed. The other spinning positions or handling units can continue to be operated in the correct way.

According to another aspect of the present invention, a spinning machine unit is proposed for carrying out a method according to one of the preferred embodiments.

The spinning machine unit comprises a plurality of spinning positions, each having at least one handling unit requiring an air flow for handling a thread or fiber band by means of the required air flow. Furthermore, the spinning machine unit has an air flow-generating source, which is connected, in an air flow-communicating manner, hereinafter referred to as "on the flow side", to an air flow duct, the air flow duct having an air flow main duct, coupled to the source on the flow side, and a plurality of air flow branch ducts branching off from the air flow main duct, each branching off to a spinning position for supplying the air flow to the spinning position's own handling unit, of which there is at least one. The spinning machine unit furthermore comprises an evaluation device for evaluating measurement data and a detection unit for detecting productive and/or non-productive spinning positions, the detection unit being connectable or connected to the evaluation device in a manner for data transmission.

The spinning machine unit is characterised in that an air volume flow measuring unit is provided which is arranged in the air flow main duct between the source and the air flow branch duct nearest to the source along the air flow path, the air volume flow measuring unit being connectable or connected to the evaluation device for data transmission. The air volume flow measuring unit can preferably be arranged in a machine end or middle frame, starting from which point the plurality of spinning positions is arranged. The machine end or middle frame can have a control housing having units for the open- and/or closed-loop control of the associated spinning positions, in which housing the air volume flow measuring unit is preferably arranged so that it can be accessed and further preferably so that it can be viewed from outside the control housing, for example through a viewing window or opening.

Furthermore, the evaluation device is set up to determine an air volume flow target value depending on the number of productive and/or non-productive spinning positions detected at the time when the air volume flow is measured, the air volume flow target value corresponding to a total air volume flow requirement of the spinning positions which are productive at the time when the measurement is taken. The evaluation device is additionally set up to compare the air volume flow target value with the actual value of the measured air volume flow and, on the basis of the comparison, to assess whether there is an unacceptable deviation between the actual value and the air volume flow target value.

The advantages attributed to the proposed method according to a preferred embodiment of the present invention can also be achieved with such a spinning machine unit. The components assigned to the spinning machine unit can preferably be further developed in such a way that the steps or processes described in the course of the method according to a preferred embodiment can be carried out and performed by the relevant component.

Preferably, according to a preferred embodiment, a further air volume flow measuring unit is arranged in at least one air flow branch duct, in particular in each air flow branch duct leading to a spinning position or directly to a handling unit, the detection unit being set up to detect, at a time when an air volume flow measurement is carried out by the further air volume flow measuring unit, whether the spinning positions or handling unit operatively connected to the further air flow measuring unit are productive and/or non-productive. In this regard, the evaluation device is set up to allocate an individual actual value of the measured air volume flow to the productive spinning position or handling unit operatively connected to the further air volume flow measuring unit, and to compare it with a corresponding individual target value which corresponds to a total air volume flow requirement of the operatively connected spinning position or handling unit. On the basis of the comparison, the evaluation device is also set up to assess whether there is an unacceptable deviation between the individual actual value and the individual target value and, if a deviation is evaluated as being unacceptable, to initiate an alarm signal which includes information on the further air volume flow measuring unit, spinning position, handling unit and/or air flow branch duct affected by the unacceptable deviation.

Furthermore, according to an embodiment, a closing element is preferably arranged in the air flow branch duct, which comprises a further air volume flow measuring unit, and is movable between an open and closed position, the closing element being in the closed position for sealing off the air flow supply of the associated spinning position and/or handling unit if a deviation affecting the air flow branch duct which has the closing element has been evaluated as being unacceptable.

Further features and advantages of the invention will become clear from the following description of preferred embodiment examples of the invention, on the basis of the figures and drawings illustrating details essential to the invention, and from the patent claims. The individual features can be implemented individually or in any desired combination in a preferred embodiment of the invention.

BRIEF DESCRIPTION OF THE DRAWINGS

Preferred embodiment examples of the invention are explained in more detail below on the basis of the accompanying drawings.

In the drawings.

DESCRIPTION OF THE PREFERRED EMBODIMENTS

The following description of the embodiments of the present invention is merely exemplary in nature and is in no way intended to limit the invention, its application, or uses. The following description is provided herein solely by way of example for purposes of providing an enabling disclosure of the invention, but does not limit the scope or substance of the invention.

Figure 1:
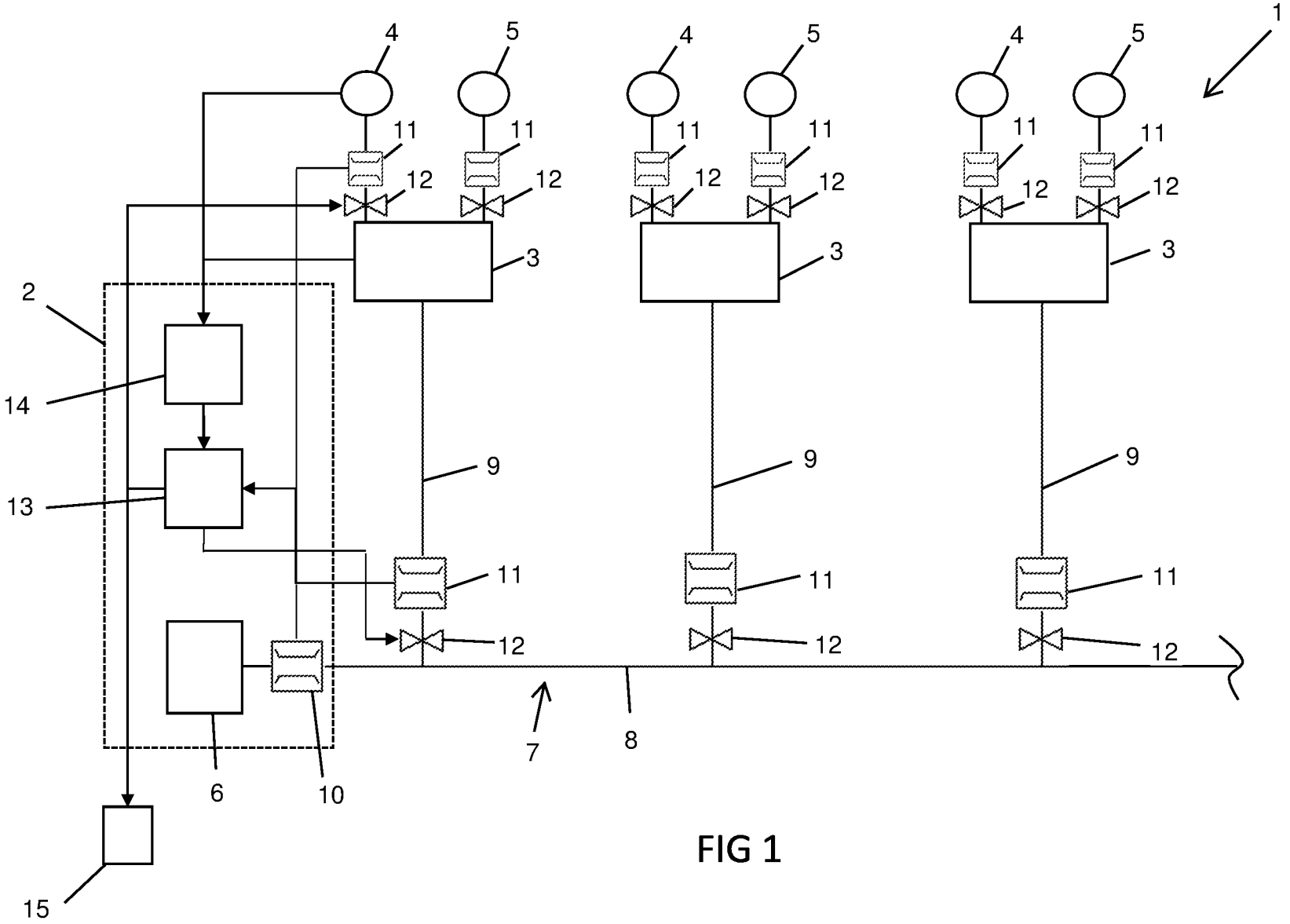
FIG. 1 is a schematic view of a spinning machine unit according to a preferred embodiment example.
Figure 2:
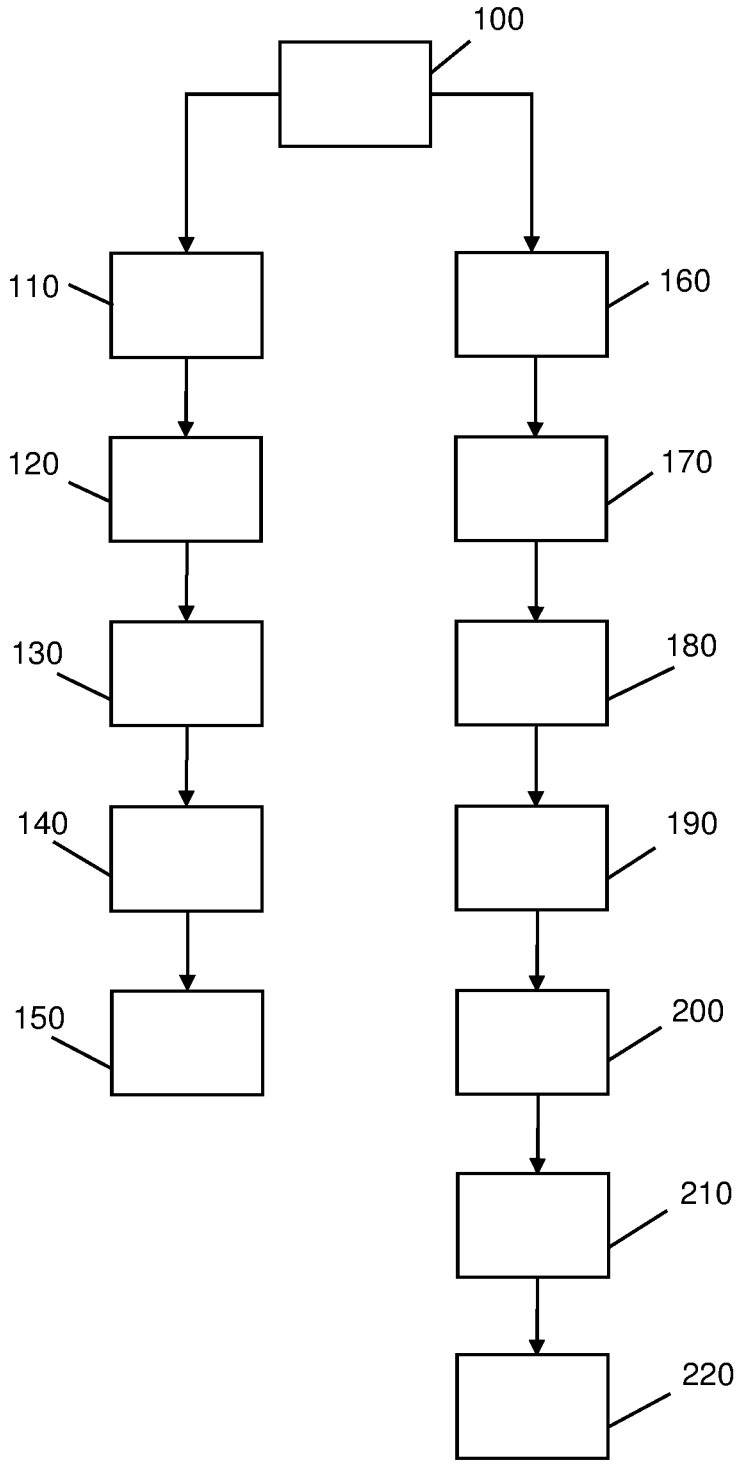
FIG. 2 is a schematic flowchart of a method according to a preferred embodiment example.

FIG. 1 is a purely schematic view of a spinning machine unit 1 according to a preferred embodiment example, which is suitable for carrying out a method 100 according to a preferred embodiment example, which is shown by the flowchart schematically represented in FIG. 2.

The spinning machine unit 1, which is, for example, a rotor spinning machine or air spinning machine, comprises a machine frame at one end of the machine having a control housing 2, from which a plurality of spinning positions 3 proceed in rows on and along a longitudinal side of the spinning machine unit, each spinning position 3 being connected on the data transmission side to a central control unit not shown in the control housing 2. Each spinning position 3 has first handling units 4 and second handling units 5 for handling a thread or fiber band to be handled at the relevant spinning position 3. Depending on the type of spinning machine, the first handling units 4 and second handling units 5 can be standard units, such as spinning rotors, pneumatic thread accumulators, spinning nozzles, compression devices or similar, which are assigned to a corresponding spinning position 3 and require an air flow for handling a thread or fiber band.

The spinning machine unit 1 comprises an air flow-generating source 6, which in this preferred embodiment example is arranged in the control housing 2. The source 6 is set up to generate an air flow caused by vacuum or positive pressure. The source 6 is connected to an air flow duct 7 in an air flow-communicating manner, hereinafter referred to as "on the flow side", the air flow duct 7 having an air flow main duct 8 and a plurality of air flow branch ducts 9 branching off from it. Each of the branching air flow branch ducts 9 leads to a spinning position 3 and to the first handling units 4 and second handling units 5 assigned to the spinning position 3, to supply them with the air flow that can be generated by the source 6.

The air flow main duct 8 has an air volume flow measuring unit 10. Air flow main duct 8 is connected to an air flow branch duct 9. An air volume flow measuring unit 10 is arranged between the source 6 and an air flow branch duct nearest to the source 6, said air volume flow measuring unit being arranged in the control housing 2 according to the preferred embodiment example shown. The air volume flow measuring unit 10 can be accessed in the control housing 2 through a maintenance flap and can be viewed in particular through a viewing window integrated in the maintenance flap. The air volume flow measuring unit 10 according to a preferred embodiment example can have a display for the scaled and/or digital indication of the measurable air volume flow channeled through.

The corresponding air flow branch duct 9 leading to a spinning position 3 as well as the air flow branch ducts 9 leading to a corresponding first handling unit 4 and second handling unit 5 have a further air volume flow measuring unit 11 for measuring the air volume flow channeled through. A closing element 12 is arranged along the air flow path between the air flow main duct 8 and the air flow branch duct 9, for example in the form of a controllable valve. The closing element 12 can be moved between an open and closed position. In the open position, an air flow can be channeled through the corresponding air flow branch duct 9 via the closing element 12, whereas the corresponding air flow branch duct 9 is sealed off for the air flow when the closing element 12 is in the closed position. The arrangement of the closing element 12 between the further air volume flow measuring unit 11 and the air flow main duct 8 is advantageous in that, in the corresponding open and closed position, it is possible to take a measurement to check whether the further air flow branch duct 9 can be supplied with the air flow accordingly or if it is sealed off.

The air volume flow measuring unit 10, the further air volume flow measuring units 11 and the closing elements 12 are connected to an evaluation device 13 on the data transmission side. In this way, air volume flow measurements can be transmitted from the air volume flow measuring unit 10 and the further air volume flow measuring units 11 to the evaluation device 13. Furthermore, the corresponding closing element 12 can be controlled so as to move it into the open or closed position. Even though the data transmission path is shown monodirectionally in the block diagram in FIG. 1, another preferred embodiment example shows that the connection can be bidirectional, in particular to be able to give or retrieve appropriate feedback.

The evaluation device 13 is also connected to a detection unit 14 on the data transmission side in monodirectional or bidirectional manner. According to this preferred embodiment example, the detection unit 14 is again connected on the data transmission side in a monodirectional or bidirectional manner to a corresponding spinning position 3 and a corresponding first handling unit 4 and second handling unit 5. In this regard, it should be emphasized that, for the sake of clarity, FIG. 1 shows only the data transmission connection of the spinning position 3 nearest to the source 6 along the air flow path, the first handling unit 4, closing elements 12 and further air volume flow measuring units 11. A corresponding connection applies in an equivalent manner to the other unconnected components shown in FIG. 1.

The detection unit 14 is set up to detect a productive and/or non-productive spinning position 3, first handling unit 4 and second handling unit 5, and to transmit to the evaluation device 13.

The spinning machine unit 1 described above according to a preferred embodiment example is set up to carry out a method 100, schematically illustrated with FIG. 2 as a flowchart, for monitoring air flows required for handling a thread and/or fiber band according to a preferred embodiment example. The method 100 has a step 110 of measuring an air volume flow by means of the air volume flow measuring unit 10, which is arranged in the air flow main duct 8. The measured value measured at a defined time or a coded value representing it is transmitted to the evaluation device 13. At the defined measurement time, in a further step 120, the number of productive and/or non-productive spinning positions 3 is detected and transmitted to the evaluation device 13. Then, in a further step 130, the evaluation device 13 determines an air volume flow target value depending on the number of detected productive and/or non-productive spinning positions 3, the air volume flow target value corresponding to a total air volume flow requirement of the spinning positions which are productive at the time the measurement is taken. The total air volume flow requirement is a theoretical value and corresponds to an air volume flow such as is necessary for the proper operation of the productive spinning positions. Usually, an individual target value is known or can be determined in advance for the correct operation of a productive spinning position, this value generally depending on the design of a particular spinning position. This value can be retrieved by the evaluation device 13 in a volatile or non-volatile memory (not shown) and can be stored in such a way that it can be changed by an operator or a control unit. The memory is at least allocated to the spinning machine and can in particular be included within it. According to a preferred embodiment example, the individual target value is multiplied by the number of productive spinning positions to obtain the air volume flow target value. Alternatively, a concordance table comprising a corresponding air volume flow target value for a corresponding different number of productive spinning positions can be retrievably stored in the memory so that an air volume flow target value can be retrieved directly depending on the number of productive spinning positions. The number of productive spinning positions can be determined directly by detecting the productive spinning positions or by detecting the non-productive spinning positions; in the latter case, a step is required involving calculating a known total number of spinning positions connected to the air flow main duct minus the detected number of non-productive spinning positions.

In a subsequent step 140, the evaluation device 13 compares the determined air volume flow target value with the actual value of the measured air volume flow and then, or in the course of the comparison in a further step 150, evaluates whether there is an unacceptable deviation between the actual value and the air volume flow target value. If a deviation is evaluated as being unacceptable, the evaluation device 13 initiates an alarm signal by which the unacceptable deviation can be indicated to an operator, e.g. via an alarm signal display unit 15 connected to the evaluation device 13 for data transmission (see FIG. 1).

The above steps can be carried out continuously, according to a preferred embodiment example, or at fixed times, in particular periodically, according to an alternative embodiment example. A loss of air volume flow in the air flow duct can be easily identified by means of monitoring. Depending on the number of spinning positions, the spinning machine unit can certainly have more than one air flow duct, in which case one air flow duct is provided to supply a defined number of spinning positions. Thus, depending on the air flow duct for which an unacceptable deviation has been evaluated, the location of the air volume flow loss can be determined more precisely.

In the spinning machine unit 1 shown by FIG. 1 according to a preferred embodiment example, further air volume flow measuring units 11 and closing elements 12 are provided, which are arranged in the air flow branch ducts 9.

In an equivalent manner to the above-described monitoring of the air flow main duct 8, an air flow branch duct 9 can also be monitored for an unusual air volume flow loss such as a leak. For this purpose, the air volume flow is measured in a step 160 by means of a further air volume flow measuring unit 11 and transmitted to the evaluation device 13. At the time the measurement is taken, the detection unit 14 detects the productive and/or non-productive spinning positions 3 and/or first handling unit 4 and second handling unit 5 in a step 170. In a step 180, a corresponding measured individual actual value of the measured air volume flow is assigned to the detected productive spinning positions and/or handling units, or vice versa, in order to be able to compare it, in a further step 190, with a corresponding individual target value, the individual target value corresponding to an air volume flow requirement of the relevant operatively connected spinning position or handling unit. On the basis of the comparison, the evaluation device 13 carries out an evaluation in the course of a step 200 to determine whether there is an unacceptable deviation between the individual actual value and the individual target value. If a deviation is evaluated as being unacceptable, the evaluation device initiates an alarm signal in a step 210, which includes information about the further air volume flow measuring unit, spinning position, handling unit and/or air flow branch affected by the unacceptable deviation, thereby making it even simpler to locate the unacceptable deviation. Furthermore, in the event of a deviation being assessed as unacceptable, the air flow branch duct 9 affected by the unacceptable deviation is sealed off from the air flow supply by moving the closing element 12 from the open position to the closed position in a step 220. In this way, other spinning positions or handling units not connected to the air flow branch duct 9 and requiring the air flow can continue to be operated correctly and, at the same time, the air flow branch duct 9 in question can be examined to determine the reasons for the unacceptable deviation.

Further air volume flow measuring units 11 and/or closing elements 12 can be provided as required in air flow branch ducts 9 of the spinning machine unit 1. For example, only additional air volume flow measuring units 11 or only closing elements 12 may be arranged in selected air flow branch ducts 9. The method 100 described above can also be suitably adapted depending on an arrangement of further air volume flow measuring units 11 and/or closing elements 12. In this way, the relevant method steps or steps selected from them can be carried out for one air flow branch duct 9 and/or air flow main duct 8 or for a plurality of air flow branch ducts 9 and/or air flow main ducts 8, in order to be able to determine air volume flow losses in the relevant air flow branch ducts 9 and/or air flow main ducts 8.

LIST OF REFERENCE SIGNS

1 Spinning machine unit
2 Control housing
3 Spinning position
4 First handling unit
5 Second handling unit
6 Air flow-generating source
7 Air flow duct
8 Air flow main duct
9 Air flow branch duct
10 Air volume flow measuring unit
11 Further air volume flow measuring unit
12 Closing element
13 Evaluation device
14 Detection unit
15 Alarm signal display unit
100 Method
110 Step of measuring an air volume flow using the air volume flow measuring unit
120 Step of detecting the productive and/or non-productive spinning positions
130 Comparison step
140 Evaluation step
150 Step of initiating an alarm signal
160 Step of measuring an air volume flow using the air volume flow measuring unit
170 Step of detecting the productive and/or non-productive spinning positions and/or handling units
180 Assignment step
190 Step of comparing the individual target value with the individual actual value
200 Evaluation step
210 Step of initiating an alarm signal
220 Sealing-off step It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A method for monitoring air flows required for handling a thread and/or fiber band in a spinning machine having a plurality of spinning positions, at least one air flow-generating source being associated with the spinning machine and being connected to an air flow duct in an air flow-communicating manner, the air flow duct having an air flow main duct, coupled to the source in an air flow-communicating manner, and a plurality of air flow branch ducts branching off from the air flow main duct, each branching off to a spinning position for supplying the air flow to handling units of the spinning positions for handling a thread or fiber band, and the spinning machine being allocated an evaluation device for evaluating measurement data and a detection unit for detecting one or more of productive spinning positions, non-productive spinning positions, and handling units, the detection unit being connected to the evaluation device for data transmission, characterised in that an air volume flow measuring unit is provided which is arranged in the air flow main duct between the source and the air flow branch duct nearest to the source along the air flow path, the air volume flow measuring unit being connected to the evaluation device for data transmission, measuring the air volume flow by the air volume flow measuring unit and transmitting a measurement result to the evaluation device, detecting a number of the productive spinning positions, non-productive spinning positions, or both by the detection unit at a time of the air volume flow measurement and transmitting to the evaluation device, determining an air volume flow target value depending on the number detected at the time when the air volume flow is measured, the air volume flow target value corresponding to a total air volume flow requirement of the spinning positions which are productive at the time when the measurement is taken, comparing the air volume flow target value with an actual value of the measured air volume flow by the evaluation device, and carrying out by the evaluation device an evaluation on the basis of a comparison to assess whether there is an unacceptable deviation between the actual value of the measured air volume flow and the air volume flow target value.

2. The method according to claim 1, characterised in that an alarm signal is initiated by the evaluation device if the evaluation results in the unacceptable deviation between the actual value and the air volume flow target value.

3. The method according to claim 1, characterised in that the spinning machine is an air spinning machine, the air flow-generating source being a compressed-air source at least for generating a predetermined spinning pressure in a spinning unit of the spinning position.

4. The method according to claim 1, characterised in that a further air volume flow measuring unit is arranged in at least one air flow branch duct.

5. The method according to claim 4, wherein the at least one air flow branch duct leads to one of the plurality of spinning positions or directly to one of the handling units.

6. The method according to claim 4, characterised in that, the at least one air flow branch duct further comprises an air volume flow measuring unit, a closing element movable between an open and closed position, the closing element being moved into the closed position if a deviation affecting the at least one air flow branch duct which has the closing element has been evaluated as being unacceptable.

7. The method according to claim 6, wherein the closing element is arranged along the air flow path between the air flow main duct and the air flow branch duct.

8. A spinning machine unit comprising:

a plurality of spinning positions, each having at least one handling unit requiring an air flow for handling a thread or fiber band by required air flow, an air flow-generating source connected to an air flow duct in an air flow-communicating manner, the air flow duct having an air flow main duct, coupled to the source in an air flow-communicating manner, and a plurality of air flow branch ducts branching off from the air flow main duct, each branching off to a spinning position for supplying the air flow to a handling unit of the spinning position, of which there is at least one, an evaluation device for evaluating measurement data, and a detection unit for detecting productive and/or non-productive spinning positions, the detection unit being connectable or connected to the evaluation device for data transmission, characterised in that an air volume flow measuring unit is provided which is arranged in the air flow main duct between the source and the air flow branch duct nearest to the source along an air flow path, the air volume flow measuring unit being connectable or connected to the evaluation device, and the evaluation device is set up to determine an air volume flow target value depending on a number of productive and/or non-productive spinning positions detected at a time when an air volume flow is measured, the air volume flow target value corresponding to a total air volume flow requirement of the spinning positions which are productive at the time when a measurement is taken, to compare the air volume flow target value with an actual value of the measured air volume flow, and to carry out an evaluation on the basis of comparison to assess whether there is an unacceptable deviation between the actual value and the air volume flow target value.

9. The spinning machine unit according to claim 8, characterised in that a further air volume flow measuring unit is arranged in at least one air flow branch duct.

10. The spinning machine unit according to claim 8, wherein the further air volume flow measuring unit is arranged in each air flow branch duct leading to a spinning position or directly to a handling unit.

11. The spinning machine unit according to claim 8, characterised in that, in an air flow branch duct comprising a further air volume flow measuring unit, a closing element is arranged along the air flow path between the air flow main duct and the air flow branch duct, the closing element movable between an open and closed position, the closing element being in the closed position if a deviation affecting the air flow branch duct which has the closing element has been evaluated as being unacceptable.

* * * * *